US010900155B2

(12) United States Patent
Nitta

(10) Patent No.: US 10,900,155 B2
(45) Date of Patent: Jan. 26, 2021

(54) INSTRUMENT FOR MAKING RIBBON EMBELLISHMENT

(71) Applicant: CLOVER MFG. CO., LTD., Osaka (JP)

(72) Inventor: Kumiko Nitta, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 481 days.

(21) Appl. No.: 15/584,777

(22) Filed: May 2, 2017

(65) Prior Publication Data

US 2017/0335497 A1 Nov. 23, 2017

(30) Foreign Application Priority Data

May 19, 2016 (JP) ..... 2016-100929

(51) Int. Cl.

| | |
|---|---|
| ***D04D 7/00*** | (2006.01) |
| ***D04D 11/00*** | (2006.01) |
| ***D04D 7/02*** | (2006.01) |
| *D04D 7/10* | (2006.01) |

(52) U.S. Cl.

CPC ..... *D04D 11/00* (2013.01); *D04D 7/02* (2013.01); *D04D 7/00* (2013.01); *D04D 7/10* (2013.01)

(58) Field of Classification Search

CPC ..... D04D 7/10; D04D 1/02; A41D 25/025; D06C 3/00; D06C 3/08; D05C 1/02; D04B 17/00; D04B 19/00; D04B 31/00; D05B 91/00; D05B 91/10; D05B 97/02

USPC ..... 223/46, 44, 24, 37; 28/147, 149, 150; 87/35; 38/102, 102.1, 102.2, 102.6, 38/102.8, 102.9; 112/258

See application file for complete search history.

(56) References Cited

U.S. PATENT DOCUMENTS

| | | | | | |
|---|---|---|---|---|---|
| 1,842,444 | A | * | 1/1932 | Chason | D05C 1/02 112/121 |
| 1,924,490 | A | * | 8/1933 | Fincke | D05B 91/10 38/102.2 |
| 2,088,455 | A | * | 7/1937 | Witt | D04D 7/10 28/150 |
| 2,093,828 | A | * | 9/1937 | Carlson | A41G 1/02 28/150 |
| 2,667,117 | A | * | 1/1954 | Millard | A47J 36/20 99/418 |
| 3,021,038 | A | * | 2/1962 | Dean | D04D 7/10 223/46 |
| 3,411,677 | A | * | 11/1968 | Bickner | D04D 7/10 223/46 |

(Continued)

OTHER PUBLICATIONS

"Tezukuri Rosette", published by Bunka Publishing Bureau, sixth impression, p. 44-47, Jan. 13, 2015.

*Primary Examiner* — Jillian K Pierorazio
(74) *Attorney, Agent, or Firm* — Hamre, Schumann, Mueller & Larson, P.C.

(57) ABSTRACT

An instrument for making a ribbon embellishment is provided. The instrument is made up of a ring-shaped plate, and a plurality of extensions each extending from the ring-shaped plate toward the center of the circular plate. The plurality of extensions include a first extension, a second extension and a third extension, and the first extension has a first surface and a second surface opposite to the first surface. In plan view, the second extension faces the first surface of the first extension, and the third extension faces the second surface of the first extension.

10 Claims, 7 Drawing Sheets

(56) References Cited

U.S. PATENT DOCUMENTS

| | | | | | |
|---|---|---|---|---|---|
| 4,391,030 | A * | 7/1983 | Weidner | A01G 23/04 | 28/149 |
| 4,651,908 | A * | 3/1987 | Ford | D04D 7/10 | 223/46 |
| 4,953,452 | A * | 9/1990 | Tarlow | A47J 27/212 | 116/221 |
| 5,526,967 | A * | 6/1996 | Kim | B65D 85/182 | 206/297 |
| D741,591 | S * | 10/2015 | Shainwald | D3/26 | |
| 2013/0015214 | A1* | 1/2013 | Ranzau | A41D 25/08 | 223/46 |

* cited by examiner

INSTRUMENT FOR MAKING RIBBON EMBELLISHMENT

FIELD

The present disclosure relates to an instrument for making a ribbon embellishment.

BACKGROUND

A ribbon embellishment called a "rosette" has been known as a decorative object. A ribbon rosette is made of material (strip of ribbon) pleated into round, floral design (like a rose), with a button, covered with a decorative cloth, attached to the center of the floral design. Conventional techniques for making rosettes can be found in several books available on the market (for instance, see a Japanese book titled "Tezukuri Rosette", published by BUNKA PUBLISHING BUREAU, sixth impression, Jan. 13, 2015, p. 44-p. 47).

By a conventional technique, however, it is rather difficult and needs some skills to make a ribbon rosette having a desired circular shape. Thus, novel ways need to be devised, whereby a ribbon embellishment including a ribbon rosette can be produced more easily.

SUMMARY

The present disclosure is presented in view of the above circumstances. It is therefore an object of the disclosure to provide teachings of how to make a ribbon embellishment in a easier manner than is conventionally possible.

According to an aspect of the present disclosure, there is provided an instrument for making a ribbon embellishment. The instrument may include a ring-shaped plate, and a plurality of extensions each extending from the ring-shaped plate toward the center of the ring-shaped plate. The plurality of extensions include a first extension, a second extension and a third extension, where the first extension has a first surface and a second surface opposite to the first surface, and in plan view, the second extension faces the first surface of the first extension, while the third extension faces the second surface of the first extension.

Other features and advantages of the present disclosure will become more apparent from detailed description given below with reference to the accompanying drawings.

DESCRIPTION OF EMBODIMENTS

Examples of the present disclosure will be described below with reference to the accompanying drawings.

Figure 1:
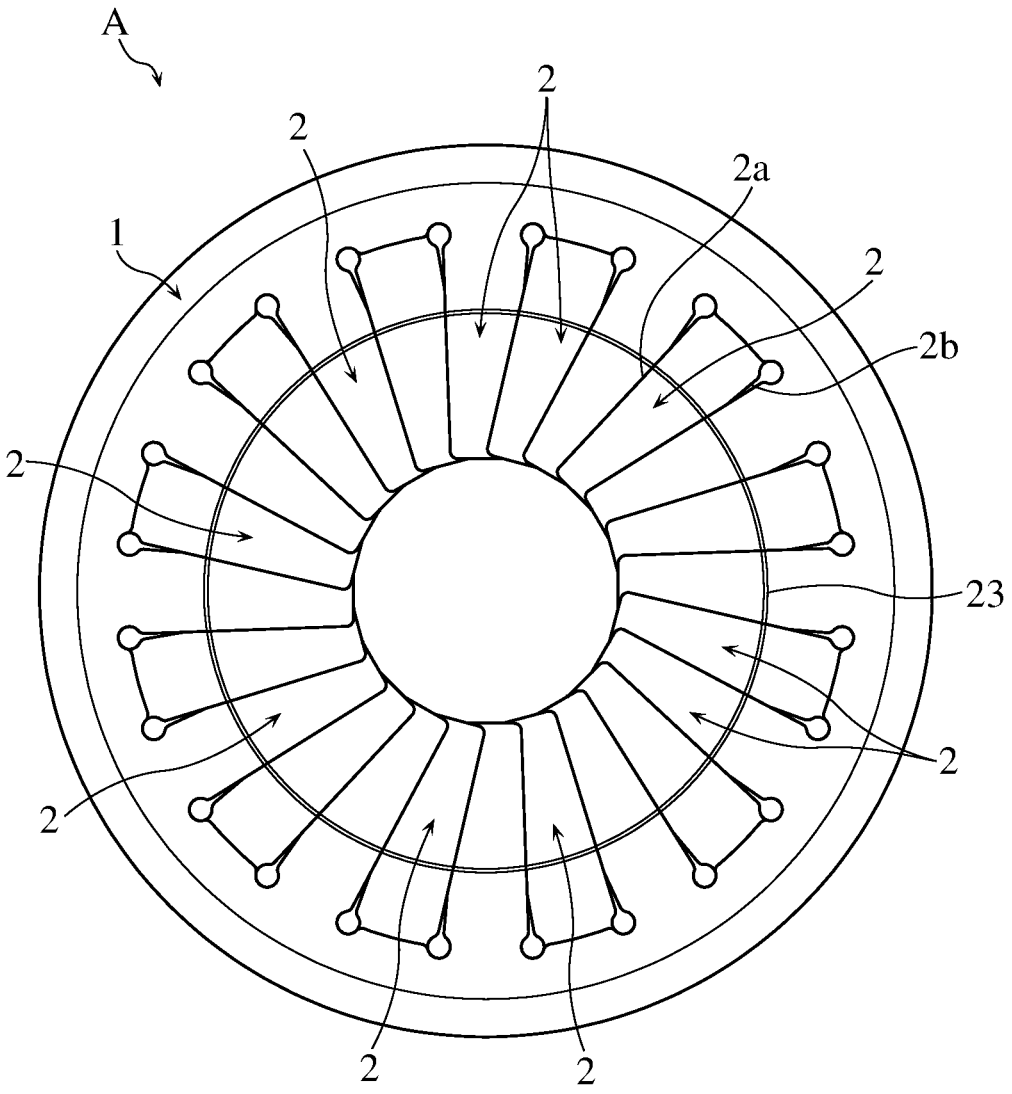
FIG. 1 is a plan view showing an example of an instrument for making a ribbon embellishment.
Figure 2:
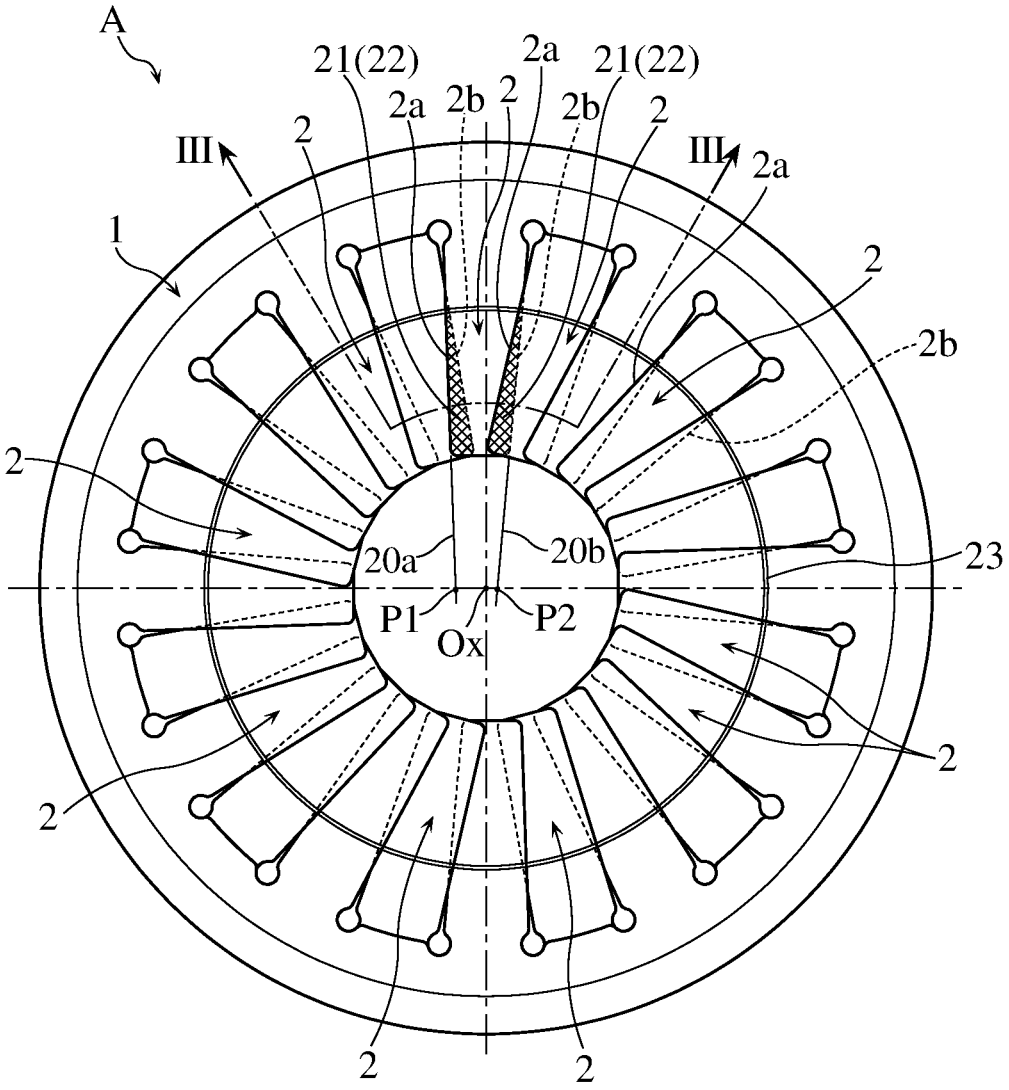
FIG. 2 shows the instrument of FIG. 1 added with some annotation for explanation.

FIGS. 1 to 4 show an embodiment of an instrument for making a ribbon embellishment (referred to as "ribbon embellishment instrument" or simply "instrument") according to the present disclosure. As shown in FIGS. 1 and 2, the instrument A includes a ring-shaped plate 1 and a plurality of extensions 2. The instrument A may be configured to make a ribbon embellishment such as a rosette, using a strip of ribbon. In particular, the instrument A is used to make a pleated portion of a rosette, as will be described in detail below.

In plan view, the instrument A has a circular outer circumference provided by the ring-shaped plate 1. The plate 1 has a predetermined thickness so as to make the instrument A sufficiently rigid for use.

Each extension 2 extends inwardly from the ring-shaped plate 1. In other words, each extension 2 extends toward the center Ox (FIG. 2) from the inner circumference of the ring-shaped plate 1. The plurality of extensions 2 are arranged with a constant pitch in a circumferential direction of the ring-shaped plate 1. The extensions 2 have substantially the same shape and size. In the illustrated example, the instrument A includes an even number (twenty four) of extensions 2.

Each extension 2 has a first edge 2*a* and a second edge 2*b*. The first edge 2*a* extends linearly at one side of the extension 2 in the circumferential direction of the ring-shaped plate 1, while the second edge 2*b* extends linearly at the other side. Thus, in each extension 2, the first edge 2*a* and the second edge 2*b* are spaced apart from each other in the circumferential direction of the ring-shaped plate 1.

Figure 3:
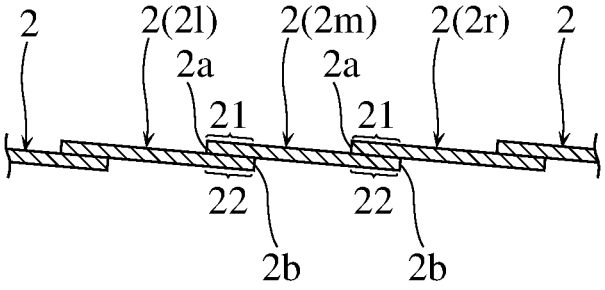
FIG. 3 is a cross-sectional view along the line III-III in FIG. 2.

Further, each extension 2 is flanked by two adjacent extensions 2 in the circumferential direction of the ring-shaped plate 1. In plan view, these two adjacent extensions 2 each partially overlaps with (or faces) the middle extension 2, as indicated by two cross-hatched marginal portions 21, 22. In the thickness direction of the ring-shaped plate 1, as seen from FIG. 3, the middle extension 2*m* has an upper surface and an opposite or lower surface, between which two marginal portions 21, 22 are provided to be spaced apart from each other in the circumferential direction of the plate 1. In FIG. 3, the left marginal portion 21 of the middle extension 2*m* overlaps with the right marginal portion 22 of the left-side adjacent extension 21, while the right marginal portion 22 of the middle extension 2*m* overlaps with the left marginal portion 21 of the right-side adjacent extension 2*r*. In other words, the left-side adjacent extension 21 may partially face, or may partially be held in contact with, the lower surface of the middle extension 2*m*, while the right-side adjacent extension 2*r* may partially face, or may be held in contact with, the upper surface of the middle extension 2*m*. Thus, in the thickness direction of the ring-shaped plate 1, each extension 2 is sandwiched between two corresponding adjacent extensions 2.

The ring-shaped plate 1 and the extensions 2 may be made of a resin material such as polypropylene. In the illustrated example, the ring-shaped plate 1 is approximately 6 to 15 cm in outer diameter and approximately 0.6 to 1.6 mm in thickness, and the extensions 2 are approximately 0.3 to 0.8 mm in thickness and approximately 6 to 12 mm in width (measured in the circumferential direction of the ring-shaped plate 1). The extensions 2 are made appropriately small in thickness. This allows for elastic deformation (i.e., bending deformation) of the extensions 2 when an appropriate force is applied in the thickness direction.

The first edge 2*a* and the second edge 2*b* of each extension 2 come closer to each other as proceeding toward the center of the ring-shaped plate 1. In the present embodiment, as shown in FIG. 2, the extension line 20*a* of the first edge 2*a* intersects the horizontal line (extending through the center Ox of the ring-shaped plate 1) at a first position P1, while the extension line 20*b* of the second edge 2*b* intersects the same horizontal line at a second position P2, which is opposite to the first position P1 with respect to the center Ox. As illustrated in the figure, the distance between the first position P1 and the center Ox is unequal to the distance between the second position P2 and the center OX, more specifically, the former distance is greater than the latter distance.

The plurality of extensions 2 are provided with a circular guide line 23 which is concentric to the ring-shaped plate 1, as viewed in plan. The circular guide line 23 extends across the plurality of extensions 2 to form a complete circle.

Figure 4:
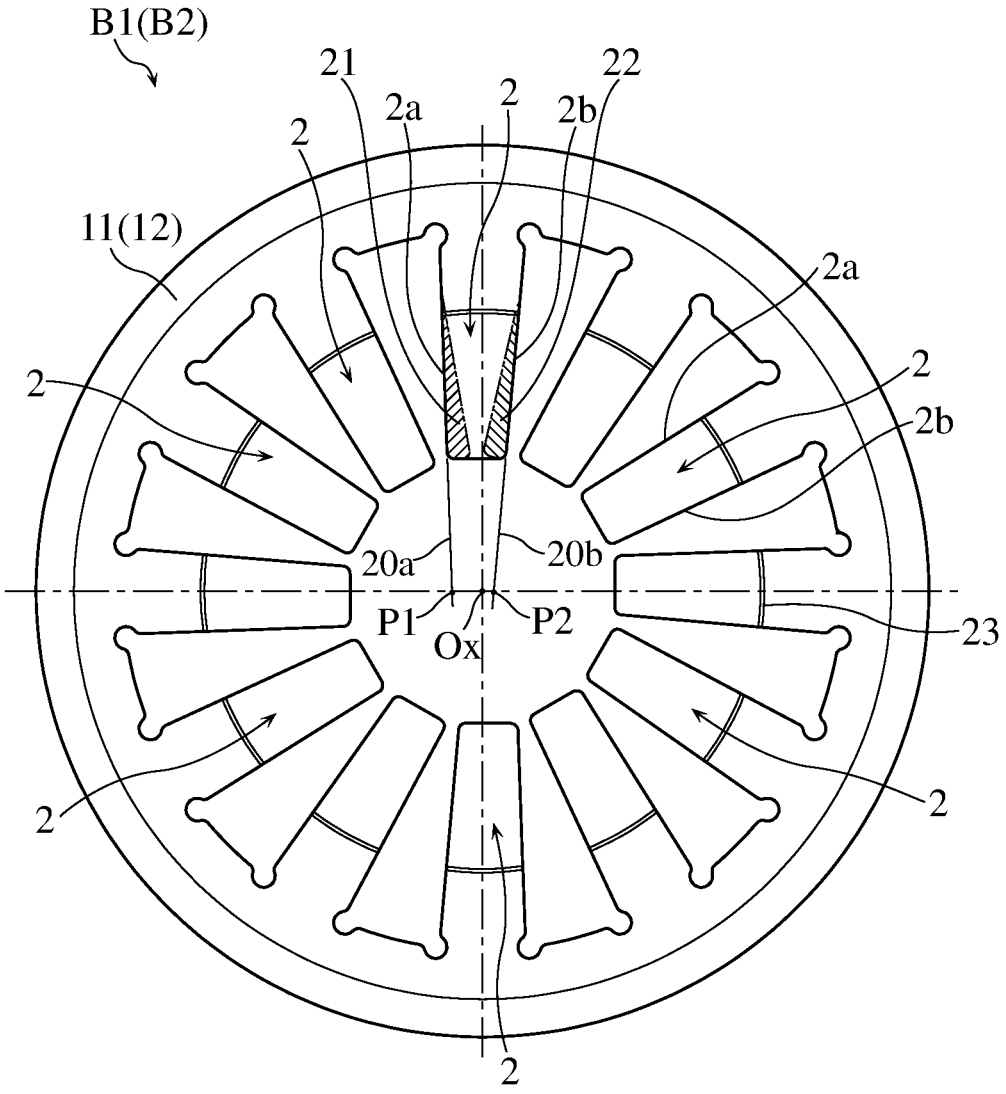
FIG. 4 is a plan view showing one of the two ring members used for forming the complete instrument shown in FIG. 1.

In the present embodiment, the instrument A may be made up of two ring members B1, B2 which are substantially identical in shape. FIG. 4 shows one ring member B1 (or B2). The ring member B1 (or B2) has a ring plate 11 (or a ring plate 12), which is annular, and also has a plurality of extensions 2. These extensions 2 are arranged with a constant pitch in the circumferential direction of the ring plate 11 (or the ring plate 12). The ring member B1 (or B2) is provided with 12 extensions 2 which do not overlap with each other in plan.

The ring plate 11 and the ring plate 12 are placed on each other in the thickness direction, and are joined by appropriate fixing means such as welding or bonding. The two ring plates 11, 12 joined together form the ring-shaped plate 1.

In the joined state, the 12 extensions 2 of the ring plate 11 are offset by half the pitch in the circumferential direction from the cooperating 12 extensions 2 of the other ring plate 12. Adjacent extensions 2 partially overlap with each other as viewed in the thickness direction, and as shown in FIG. 2, the overlapping portions of the extensions 2 are adjusted so that the first portions 21 (adjacent to the first edges 2*a*) are positioned on the front side in the figure. FIG. 4 also shows a first portion 21 and a second portion 22, together with extension lines 20*a*, 20*b*, first and second positions P1, P2, and the center Ox.

As understood from FIGS. 2 and 4, a half of all the extensions 2 of the instrument A are provided on the ring plate 11, while the other half of the extensions 2 are provided on the ring plate 12.

Next, advantages of the instrument A are described with reference to FIGS. 5 to 8.

Figure 5:
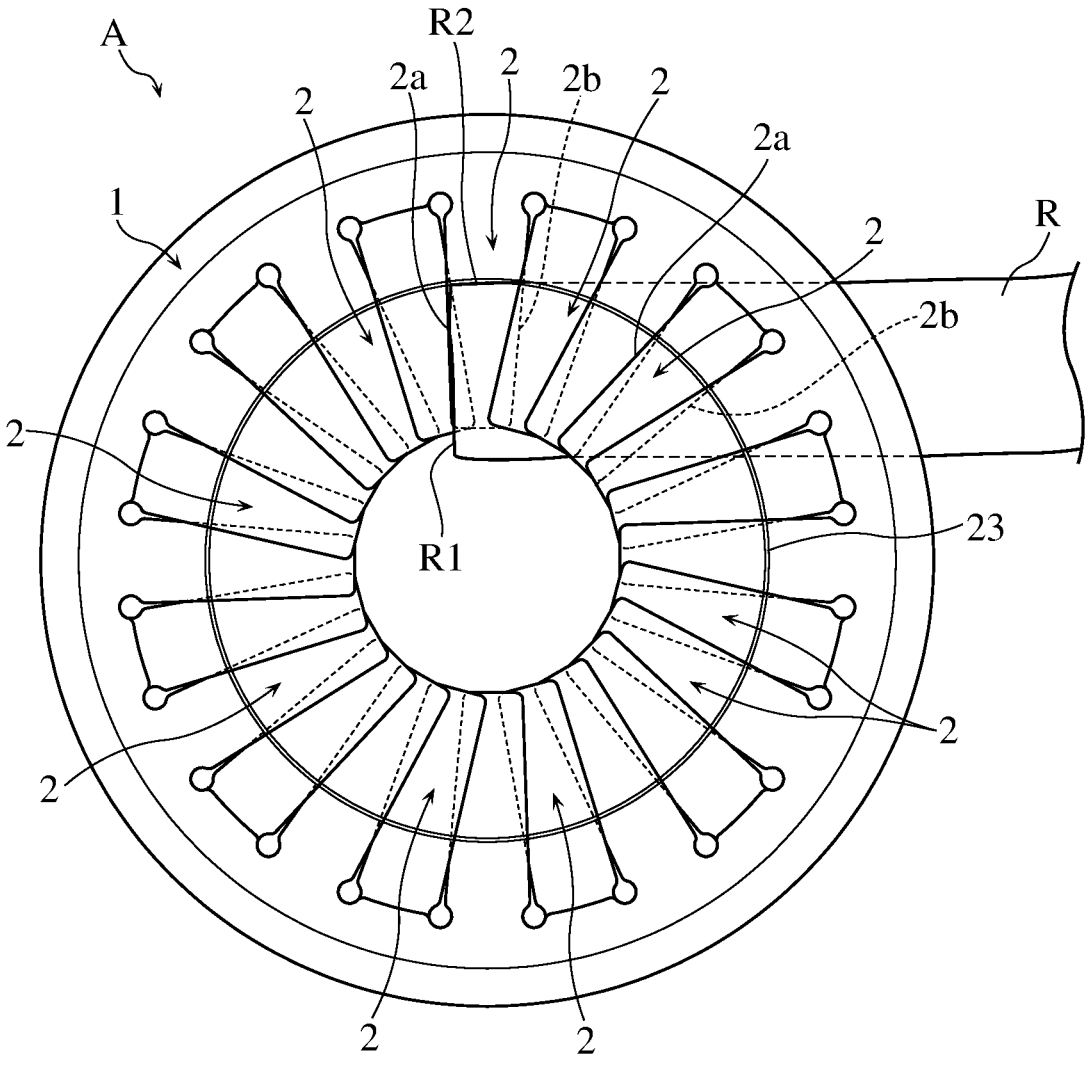
FIG. 5 is a plan view illustrating the use of the instrument of FIG. 1.

The instrument A is used to make the pleated portion of a rosette. First, an appropriate length of ribbon R is prepared, and as shown in FIG. 5, an end of the ribbon R is inserted between two adjacent extensions 2 from the back side of the instrument A so that an edge R1 of the ribbon R (extending widthwise of the ribbon) is formed along the first edge 2*a* of the upper one of the two extensions 2. At this point, the longitudinal edge R2 of the ribbon R is aligned with the guide line 23.

Figure 6:
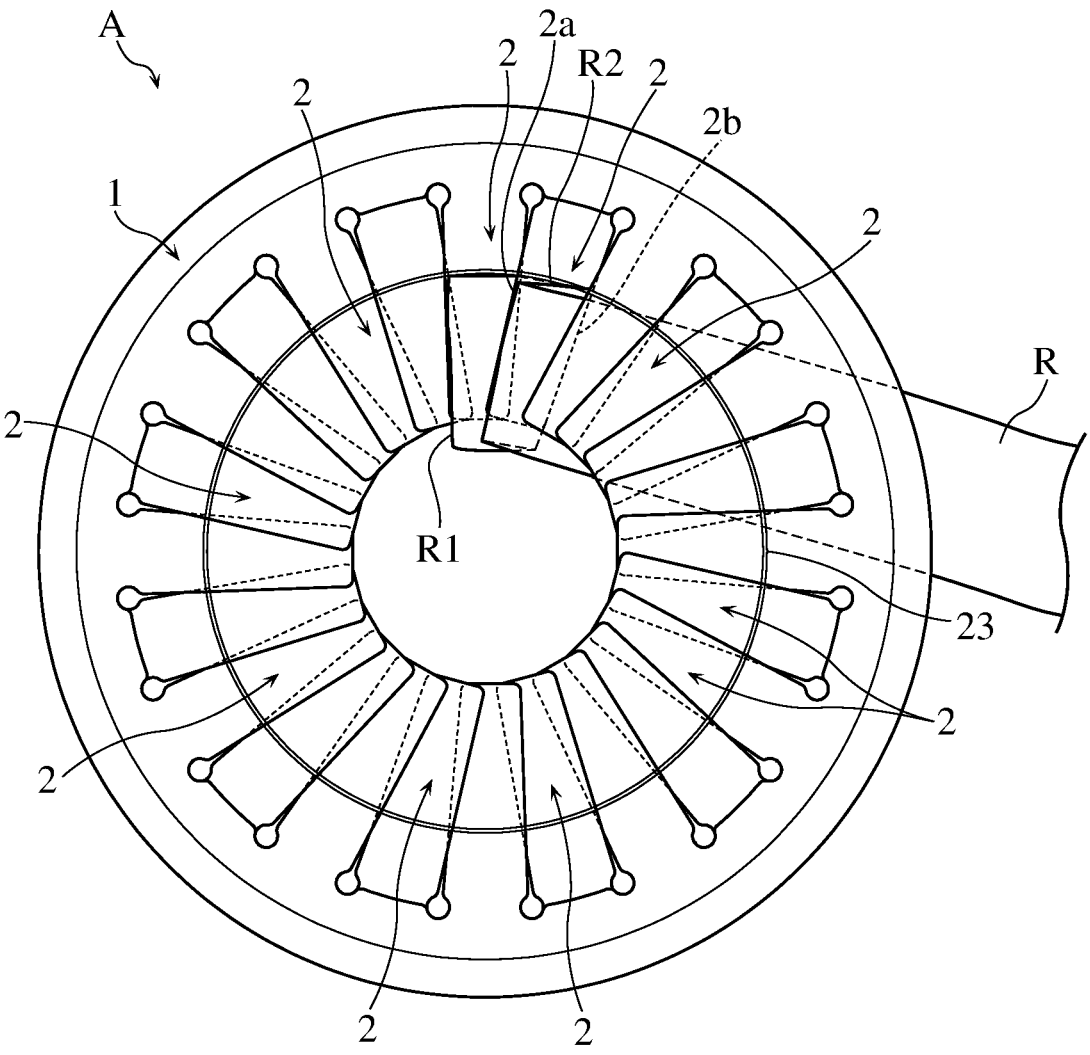
FIG. 6 is another plan view illustrating the use of the instrument of FIG. 1.

Next, as shown in FIG. 6, the ribbon R is folded back along he second edge 2*b* of the second extension 2 (adjacent to the first extension 2 in the clockwise direction) toward the first extension 2. At this stage, the folded portion of the ribbon R can be held between a second pair of adjacent extensions 2 (i.e., the second and third extensions). Then the ribbon R is aligned with and folded back along the first edge 2*a* of the second extension 2 (FIG. 6). At this point again, the longitudinal edge R2 of the ribbon R is aligned with the guide line 23.

Figure 7:
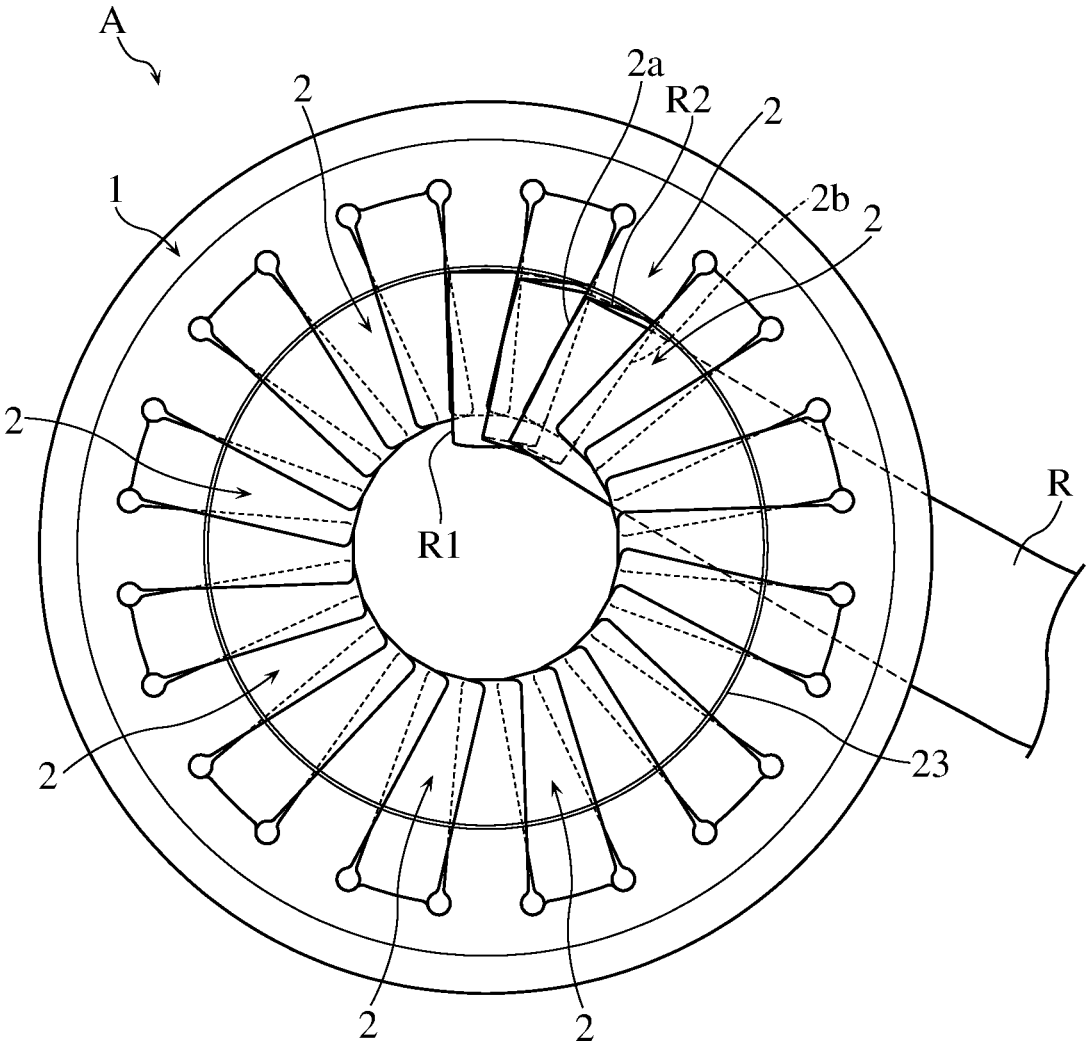
FIG. 7 is another plan view illustrating the use of the instrument of FIG. 1.

Next, as shown in FIG. 7, the ribbon R is folded back along the second edge 2*b* of the third extension 2 toward the second extension 2. The newly folded portion of the ribbon R can be held between the second and the third extensions 2. Again, the ribbon R is aligned with and folded back along the first edge 2*a* of the third extension 2, with the longitudinal edge R2 of the ribbon R aligned with the guide line 23.

Figure 8:
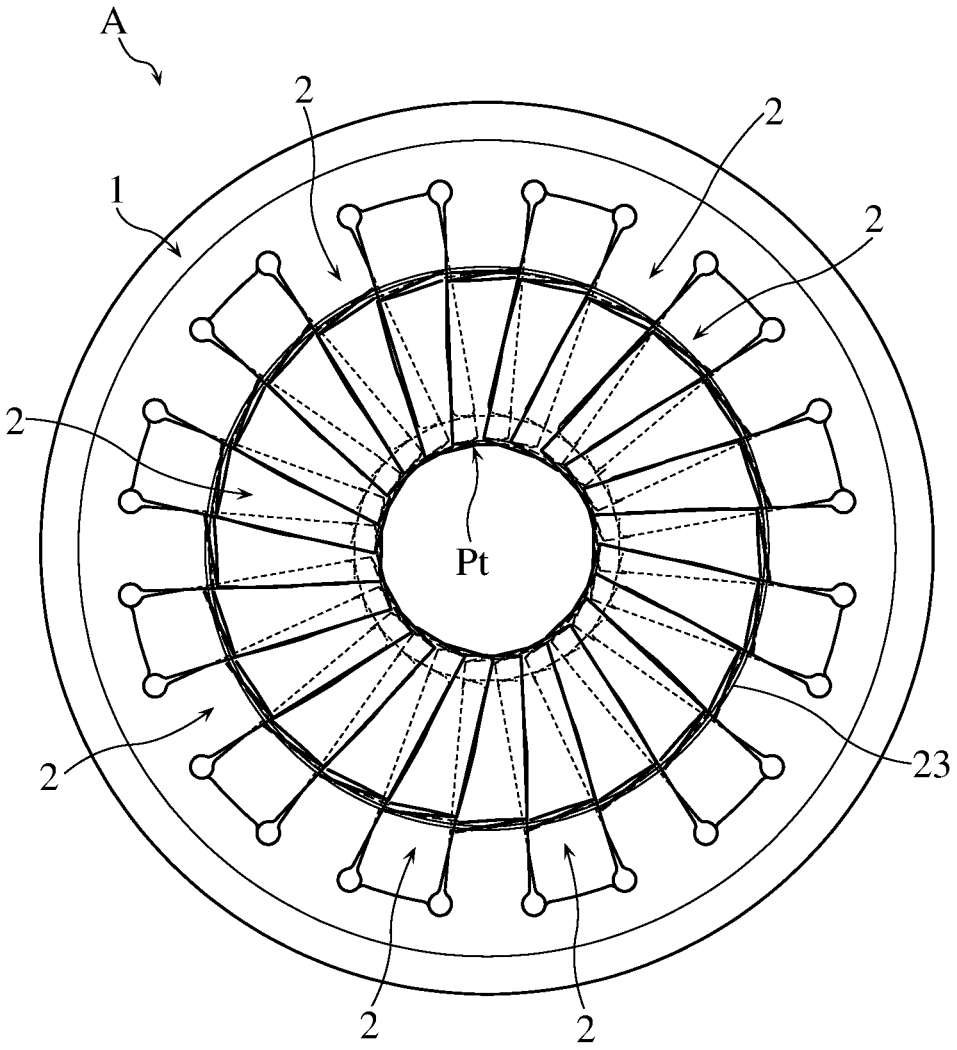
FIG. 8 is another plan view illustrating the use of the instrument of FIG. 1.

The above-described operation is repeated in the clockwise direction. As a result, a pleated portion Pt having a substantially circular shape is formed, as shown in FIG. 8. Subsequently, the unneeded portion of the ribbon R is cut off, and the pleated portion Pt is sewn around the vicinity of its inner circumferential edge so that the shape of the pleated portion Pt is maintained. Then the pleated portion Pt is removed from the instrument A by releasing the parts of the pleated portion Pt that are held between the extensions 2. An additional ornament (such as a ribbon piece or a covered button) may be attached to the pleated portion Pt so as to obtain a desired rosette.

Regarding the instrument A according to the present embodiment, each adjacent pair of the plurality of extensions 2 is such that the first portion 21 of one of the pair of extensions 2 and the second portion 22 of the other of the pair of extensions 2 overlap with each other as viewed in the thickness direction of the ring-shaped plate 1. Also, as shown in FIG. 3, the first portions 21 of the respective extensions 2 are always on the same side with respect to the second portions 22 overlapping therewith. As such, the pleated portion Pt can be formed by repeatedly performing the operation of inserting the ribbon R between adjacent pairs of extensions 2 and folding back the ribbon R. Further, sewing does not need to be carried out each time the ribbon R is folded back. Rather, sewing is carried out only once after the shape of the pleated portion Pt is finalized.

As described above, the ribbon R can be held between a number of pairs of adjacent (mutually overlapping) extensions 2 in making a pleated portion Pt, and two edges 2*a*, 2*b* of each extension as well as the circular line 23 can be used as a guide for proper making of the pleated portion Pt. Hence, the desired pleated portion Pt can be made easily and efficiently.

Further, as described above, the first and second edges 2*a*, 2*b* of each extension 2 come closer to each other as proceeding toward the center Ox of the ring-shaped plate 1, and their extension lines are spaced apart from the center Ox by different distances. Advantageously, this arrangement enables the user of the instrument to make a well-formed (circular in the illustrated example) pleated portion Pt with ease.

Though an embodiment of the present disclosure has been described, the disclosure is not limited thereto. Various modifications can be made within the scope not departing from the spirit of the disclosure. Specific shapes, materials, and the like of the instrument are not limited to those in the above embodiment. For example, the number of extensions may be changed according to the size of the instrument (i.e., the size of the pleated portion to be made).

The invention claimed is:

1. An instrument for making a ribbon embellishment, the instrument comprising:

a ring-shaped plate that has an outer rim and an inner circumference, the ring-shaped plate being formed with a single opening defined by the inner circumference; and a plurality of extensions, each extending from the inner circumference of the ring-shaped plate toward a center of the ring-shaped plate, wherein each of the plurality of extensions comprises a first end and a second end that is located further from the center of the ring-shaped plate than is the first end, the second end being fixed to the ring-shaped plate, the first end being a free end supported by the ring-shaped plate via the second end, and the plurality of extensions include a first extension, a second extension and a third extension, the first extension comprising a first surface and a second surface opposite to the first surface, in plan view the second extension faces the first surface of the first extension, and the third extension faces the second surface of the first extension, and a combination of the respective first ends of the plurality of extensions defines a circular opening that is smaller in area than the single opening of the ring-shaped plate.

2. The instrument according to claim 1, wherein the second extension is in contact with the first surface of the first extension, and the third extension is in contact with the second surface of the first extension.

3. The instrument according to claim 1, wherein the first extension, the second extension and the third extension are same in shape and size.

4. The instrument according to claim 1, wherein a region of the first surface of the first extension that the second extension faces is equal in area to a region of the second surface of the first extension that the third extension faces.

5. The instrument according to claim 1, wherein each of the first, the second and the third extensions comprises a first edge and a second edge, the extensions being arranged with a constant pitch in a circumferential direction of the ring-shaped plate, and a width of each of the extensions, defined by a distance of the first edge and the second edge of each of the extensions in the circumferential direction, is narrower at the first edge than at the second edge and gradually increases from the first edge towards the second edge.

6. The instrument according to claim 5, wherein in plan view, the center of the ring-shaped plate is disposed between a first extension line of the first edge and a second extension line of the second edge of each of the plurality of extensions.

7. The instrument according to claim 6, wherein a distance from the center of the ring-shaped plate to the first extension line is unequal to a distance from the center of the ring-shaped plate to the second extension line.

8. The instrument according to claim 1, wherein each of the plurality of extensions is elastic.

9. The instrument according to claim 1, wherein in plan view the first, second and third extensions are provided with guide lines, respectively, that are equal in distance from the center of the ring-shaped plate.

10. The instrument according to claim 1, wherein the ring-shaped plate comprises a first ring member and a second ring member cooperating with the first ring member, the first extension being provided on the first ring member, the second and the third extensions being provided on the second ring member.

* * * * *